US006786071B2

(12) United States Patent
Thiele

(10) Patent No.: US 6,786,071 B2
(45) Date of Patent: Sep. 7, 2004

(54) METHOD AND DEVICE FOR OPERATING A HOT ROLLING TRAIN WITH AT LEAST ONE EDGER

(75) Inventor: Konrad Thiele, Hemhofen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/401,928

(22) Filed: Mar. 28, 2003

(65) Prior Publication Data

US 2003/0164017 A1 Sep. 4, 2003

Related U.S. Application Data

(63) Continuation of application No. PCT/DE01/03582, filed on Sep. 17, 2001.

(30) Foreign Application Priority Data

Sep. 29, 2000 (DE) ..... 100 48 470

(51) Int. Cl.[7] ..... B21B 37/72

(52) U.S. Cl. ..... 72/7.5; 72/8.8; 72/9.4; 72/11.5

(58) Field of Search ..... 72/7.4, 7.5, 8.3, 72/8.8, 9.4, 11.1, 11.3, 11.4, 11.5, 12.2

(56) References Cited

U.S. PATENT DOCUMENTS

| | | | | | |
|---|---|---|---|---|---|
| 3,651,676 | A | * | 3/1972 | Robertson | 72/11.5 |
| 4,204,224 | A | * | 5/1980 | Buken et al. | 348/142 |
| 4,439,049 | A | * | 3/1984 | Hoogendoorn et al. | 374/124 |
| 4,656,856 | A | * | 4/1987 | Voye, Jr. | 72/11.4 |
| 4,672,830 | A | * | 6/1987 | Tsukamoto et al. | 72/9.3 |
| 4,899,547 | A | * | 2/1990 | Irwin | 62/63 |
| 5,740,686 | A | * | 4/1998 | Martinetz et al. | 72/8.4 |

FOREIGN PATENT DOCUMENTS

| | | | | |
|---|---|---|---|---|
| DE | 3117360 | A1 | 11/1982 | G01B/21/30 |
| DE | 3125476 | A1 | 1/1983 | B21B/37/00 |
| DE | 19744504 | A1 | 4/1999 | B21B/1/22 |
| EP | 0068431 | A2 | 1/1983 | G01B/11/24 |
| GB | 2101918 | | 1/1983 | B21B/1/12 |
| JP | 54-69556 | | 4/1979 | B21B/37/22 |
| WO | 02/26408 | A1 | 4/2002 | B21B/37/22 |

OTHER PUBLICATIONS

International Search Report PCT/DE 01/03582, Aug. 8, 2002.

Hamilius et al., "Die neue Quarto–Reversier–Vorstrasse mit Stauchgerüst der Warmbreitbandstrasse Sidmar," XP000103298 110 Stahl und Eisen 109 (1989) No. 22. 4 Pages, Nov. 10, 1989.

Fogel, "Breitenregelung in der Breitbandstrasse der Voest–Alpine Stahl AG," XP000247509 110 Stahl und Eisen 110 (1990) No. 11. 3 Pages, Nov. 14, 1990.

Fogel et al., "Revamping the hot strip mill at Egyptian Iron & Steel," XP000590164 Steel Times International 2 Pages, Mar. 1996.

* cited by examiner

*Primary Examiner*—Ed Tolan
(74) *Attorney, Agent, or Firm*—Baker Botts L.L.P.

(57) ABSTRACT

The invention relates to a method and device for operating a hot rolling train with at least one edger and at least one sensor with which the strip end position is determined by means of a linear recording of the infrared radiation from the rolled strip and whereby an optimization of the strip width distribution is achieved by means of a calculation system.

32 Claims, 3 Drawing Sheets

METHOD AND DEVICE FOR OPERATING A HOT ROLLING TRAIN WITH AT LEAST ONE EDGER

CROSS-REFERENCE TO RELATED APPLICATION

This application is a continuation of co-pending International Application No. PCT/DE01/03582 filed Sep. 17, 2001, which designates the United States, and claims priority to German application number DE10048470.0 filed Sep. 29, 2000.

TECHNICAL FIELD OF THE INVENTION

The invention relates to a method for operating a hot rolling train with at least one edger and at least one sensor for determining the position of the ends of the strip, an optimization of the strip width distribution of at least one end of a rolled strip being achieved by means of a calculating system.

The invention also relates to a device for operating a hot rolling train with at least one edger and at least one sensor for determining the position of the ends of the strip, an optimization of the strip width distribution of at least one end of a rolled strip being achieved by means of a calculating system.

BACKGROUND OF THE INVENTION

One of the main problems when rolling strips, for example strip steel, is the achievement of a rectangular basic form with a constant width over the length of the strip. In a hot rolling train, vertical rolling stands, which are also referred to as edgers, serve for controlling the width of the strip. To be able to achieve a favorable formation of the ends of the strip and good constancy of the width of the strip over the entire length of the strip, the edgers are equipped with high-speed hydraulic adjusting systems.

If the edgers are operated with constant adjustment, the rolled strip generally becomes narrower at the ends of the strip, that is the head of the strip and the foot of the strip, than in the middle part on account of the unsymmetrical material flow and other effects. Starting out from the rectangular rolled strip form, width constrictions are obtained at the ends of the strip after an edging operation, i.e. when the rolled strip runs through the edger.

The state of stress during the edging operation leads to what is known as nosing of the head of the strip and consequently to width dimensions which, depending on the degree of edging, lie far below the adjusted setting of the edger.

In a similar way, depending on the degree of edging, this forming process also brings about negative width deviations at the rear end of the strip, i.e. at the foot of the strip, the flat pass that follows in a horizontal stand leading to a rolled strip contour which is known as a fishtail formation.

The underwidths or width constrictions occurring at the ends of the strip are primarily attributable to the asymmetrical compressive and shearing stresses in the region of the ends of the strip, introduced by the edgers and leading to an increased longitudinal flow of material because of the absence of material support. As deformation progresses, an increase in the change in vertical form comes about at the same time as the change in linear form lessens, and leads to a bead formation along the edges of the strip. This bead formation along the edges of the strip is also referred to as a dogbone form.

To counteract the fishtail formation and the formation of the so-called dogbone form, the adjusting position of the edgers is adjustable during the running through of the strip, the adjustment of the edger being opened up further, in the form of short strokes, as the ends of the rolled strip run through, in relation to the middle part. This adjustment correction at the ends of the rolled strip, i.e. at the head of the strip and at the foot of the strip, takes place in a way corresponding to an operating curve, which can be defined by predetermined operating curve parameters.

A major factor in avoiding fishtail formation and the dogbone form is the correctly timed activation of the operating curve. Depending on the position of the rolled strip, adjustment corrections to the edger are activated at the ends of the rolled strip, i.e. at the head of the strip and at the foot of the strip. To be able to carry out a correction of the adjustment position of an edger, exact detection of the ends of the strip is necessary. Previously, sensors were used in this area, but did not produce a reliable measuring signal for the detection of the ends of the strip on account of adverse ambient conditions, such as for example water and scale.

SUMMARY OF THE INVENTION

The object of the invention is to find a method of operating a hot rolling train with at least one edger and at least one sensor for determining the position of the ends of the strip, with which method a more reliable determination of the position of the ends of the rolled strip is achieved.

The invention is also based on the object of finding a device for operating a hot rolling train with at least one edger and at least one sensor for determining the position of the ends of the strip, which device permits a more reliable determination of the position of the ends of the rolled strip.

The object is achieved according to the invention by a method as claimed in claim 1. The object is further achieved according to the invention by a device as claimed in claim 7. Advantageous developments of the method and of the device are specified in the further claims.

The method according to the invention as claimed in comprises a linear recording of the infrared radiation from the rolled strip for determining the position of the ends of the strip.

The device according to the invention also includes operating a rolling train with at least one edger and at least one sensor for determining the position of the ends of the strip, an optimization of the strip width distribution of at least one end of a rolled strip being achieved by means of a calculating system, comprises a sensor which is designed as an infrared linear sensor, which is arranged upstream and/or downstream of the edger.

The problem presented at the beginning of determining the position of the ends of the rolled strip, which is made more difficult by adverse ambient conditions, such as for example by water or scale located on the rolled strip, is now solved by an infrared linear sensor. The infrared linear sensor linearly records the infrared radiation given off by the rolled strip on a predeterminable measuring area.

An advantageous refinement of the use of the infrared linear sensor is that the predeterminable measuring area runs transversely in relation to the running direction of the strip. An advantage of this alignment chosen transversely in relation to the running of the strip is that, in addition to the detection of the ends of the strip, i.e. the head of the strip (the end of the strip running into the edger first) and the foot of the strip (the end of the strip running out of the edger), a detection of the edges of the strip is also carried out. This involves determining the position of the width of the strip, with respect to the center of the rolled strip running in the longitudinal direction of said rolled strip.

A further advantageous refinement of the use of the infrared linear sensor is that the predeterminable measuring area runs longitudinally in relation to the running direction of the strip. With this alignment, cold spots lying transversely in relation to the rolled strip do not influence the detection of the ends of the strip, since the measuring area, set longitudinally in relation to the running direction of the strip, covers an extended longitudinal region of the rolled strip, and consequently also permit plausibility checks. These plausibility checks at the same time represent a higher degree of dependability and accuracy of the measured value detection.

According to an advantageous refinement, the recording of the position of the ends of the strip takes place upstream of the edger. In a further advantageous refinement of the method according to the invention, the recording of the position of the ends of the strip takes place downstream of the edger.

According to an advantageous refinement, the recording of the position of the ends of the strip takes place upstream and downstream of the edger.

BRIEF DESCRIPTION OF THE FIGURES

The invention and further advantages and details are explained in more detail below on the basis of exemplary embodiments schematically represented in the drawing, in which.

DETAILED DESCRIPTION OF THE PREFERRED EMBODIMENTS

Figure 1:
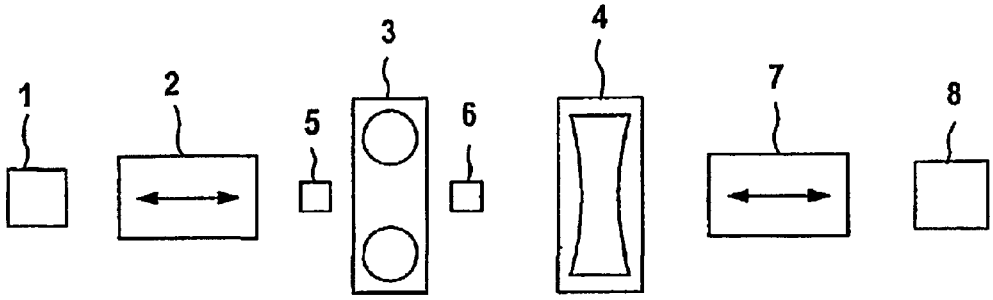
FIG. 1 shows a presented hot rolling train (reversing roughing train) with a first embodiment of the device according to the invention.

The hot rolling train represented in FIG. 1 is also referred to as a reversing roughing train. In FIG. 1, the mechanical devices belonging to a reversing roughing train and an exemplary configuration of the arrangement of the infrared linear sensors 5 and 6 are shown in extract form. Shown as mechanical equipment are a pusher-type furnace 1, a roller table 2 and a roller table 7, an edger 3, a horizontal stand 4, two infrared linear sensors 5 and 6 and also the finishing train 8, following the reversing roughing train. If a rolled strip, not represented in FIG. 1, is transported from the pusher-type furnace 1 in the direction of the roller train 7, this is referred to as an odd rolling pass. If the rolled strip is transported from the roller table 7 in the direction of the pusher-type furnace 1, this is referred to as an even rolling pass. Depending on the rolling direction, either the infrared linear sensor 5 or 6 is used. In the case of odd rolling passes, the infrared linear sensor 5 is used, in the case of even rolling passes, the infrared linear sensor 6 is used for detecting the ends of the strip. The individual rolling passes are repeated until the desired thickness of the rolled strip is achieved. Subsequently, the rolled strip is transported by the roller table 7 in the direction of the finishing train 8.

Figure 2:
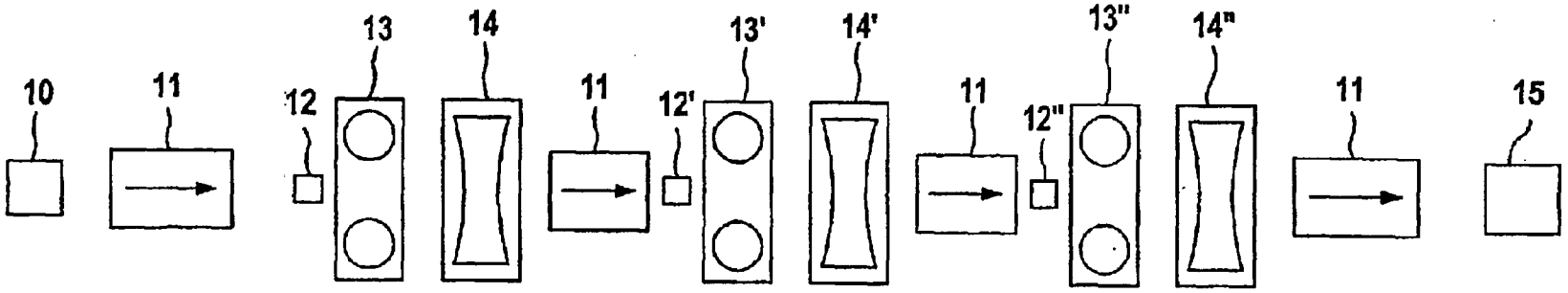
FIG. 2 shows a presented hot rolling train (continuous roughing train) with a second embodiment of the device according to the invention.

The hot rolling train represented in FIG. 2 is also referred to as a continuous rolling train. In FIG. 2, the mechanical devices belonging to a continuous roughing train and an exemplary configuration of the arrangement of the infrared linear sensors 12, 12' and 12" are shown in extract form. Shown as mechanical equipment are a pusher-type furnace 10, the roller table 11, the infrared linear sensors 12, 12' and 12", the edgers 13, 13' and 13", the horizontal stand 14, 14' and 14" and also the finishing train 15, following the continuous roughing train. The rolled strip is transported from the pusher-type furnace 10 in the direction of the finishing train 15. The infrared linear sensors 12, 12' and 12", respectively positioned upstream of the edgers 13, 13' and 13", record the ends of the strip. Depending on the detection of the ends of the strip, adjustment corrections to the edgers 13, 13' and 13" are activated. After the rolled strip has run through, i.e. when the foot of the rolled strip has left the last horizontal stand 14", the rolled strip is transported in the direction of the finishing train 15.

Figure 3:
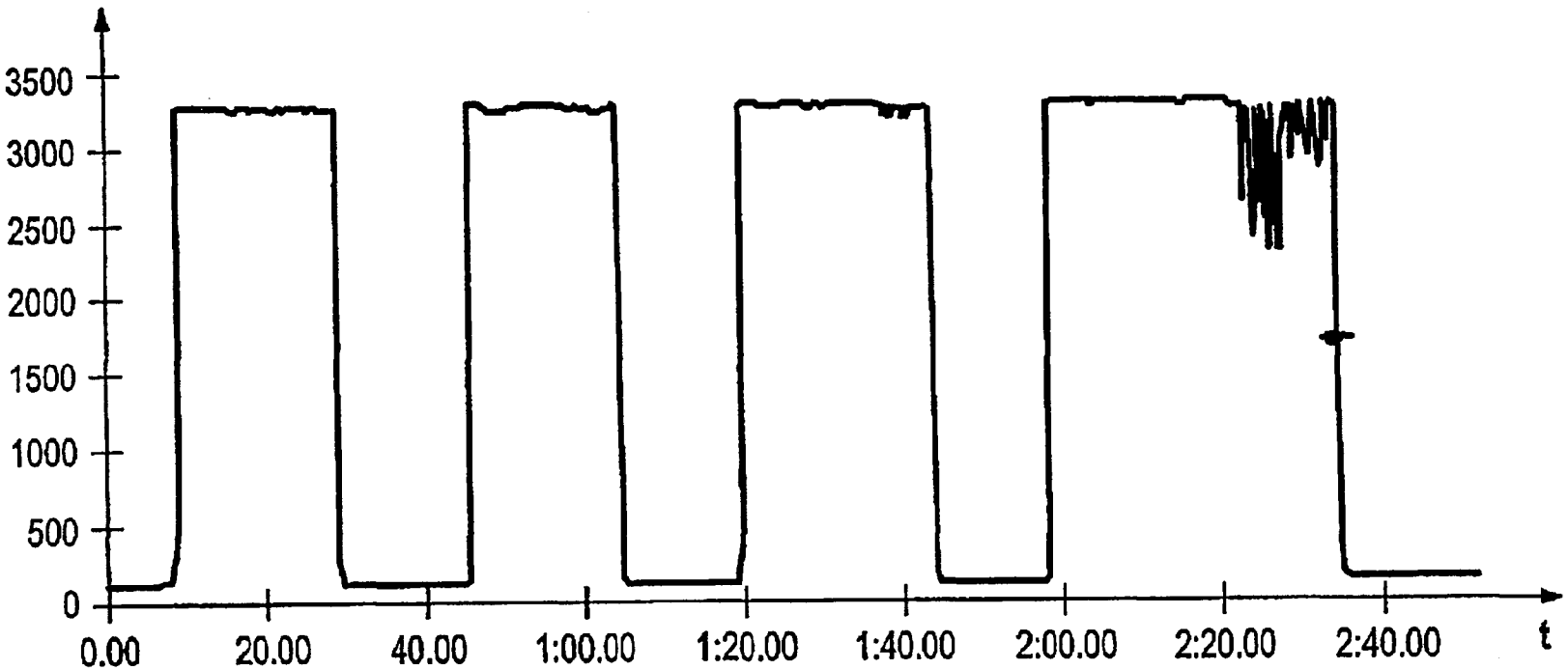
FIG. 3 shows a signal profile determined by the infrared linear sensor.

In FIG. 3, a signal profile determined by the infrared linear sensor is shown. Represented on the x-axis is a time lapse, which shows a time period of approximately 2 minutes and 50 seconds. Represented on the y-axis is the intensity of the thermal radiation from the rolled strip, measured by the infrared linear sensor. The determination of the head of the rolled strip can be seen from the rise in the intensity of the radiation. The decrease in the intensity of the thermal radiation shows the detection of the foot of the rolled strip by the infrared linear sensor. In the diagram presented, four passes of the rolled strip can be seen, i.e. the infrared linear sensor has recorded four head-of-strip signals and four foot-of-strip signals. The fourth rolled strip pass represented in the diagram shows great fluctuations of the signal determined by the infrared linear sensor. These fluctuations of the recorded intensity of the thermal radiation from the rolled strip are caused by adverse ambient conditions, such as for example by water vapor. However, these influences are clearly distinguishable from the thermal radiation of the rolled strip, and consequently do not influence the clear detection of the foot of the rolled strip.

What is claimed is:

1. A method for operating a hot rolling train with at least one edger and at least one sensor for determining the position of the ends of a strip, wherein an optimization of a strip width distribution of at least one end of a rolled strip is achieved by means of a calculating system, said system determining the position of the ends of the strip by means of a linear recording of the infrared radiation from the rolled strip; and depending on the determination of the position of the ends of a strip, activating adjustment corrections to the at least one edger.

2. The method as claimed in claim 1, wherein the measuring area of the infrared linear sensor runs transversely in relation to the running direction of the strip.

3. The method as claimed in claim 1, wherein the measuring area of the infrared linear sensor runs longitudinally in relation to the running direction of the strip.

4. The method as claimed in claim 2, wherein the position of the ends of the strip is recorded upstream of the edger.

5. The method as claimed in claim 3, wherein the position of the ends of the strip is recorded upstream of the edger.

6. The method as claimed in claim 2 wherein the position of the ends of the strip is recorded downstream of the edger.

7. The method as claimed in claim 3 wherein the position of the ends of the strip is recorded downstream of the edger.

8. The method as claimed in claim 2 wherein the position of the ends of the strip is recorded upstream and downstream of the edger.

9. The method as claimed in claim 3 wherein the position of the ends of the strip is recorded upstream and downstream of the edger.

10. A device for operating a hot rolling train comprising:

at least one edger;

at least one infrared line sensor for determining the position of the ends of a strip; and a calculating means for optimizing the strip width distribution of at least one end of a rolled strip, wherein adjustment corrections to the at least one edger are activated depending on the determination of the position of the ends of a strip.

11. The device as claimed in claim 10, wherein the infrared linear sensor is arranged upstream of the edger.

12. The device as claimed in claim 10, wherein the infrared linear sensor is arranged downstream of the edger.

13. The device as claimed in claim 10, further comprising another infrared linear sensor.

14. The device as claimed in claim 13, wherein an infrared linear sensor is arranged upstream and an infrared linear sensor is arranged downstream of the edger.

15. An improved method for operating a hot rolling train, said improvement comprising:

optimizing a strip width distribution by means of a calculating system, said system determining the position of the ends of the strip by recordation of the radiation from the strip, whereby, depending on the determination of the position of the ends of the strip. activating adjustment corrections to an edger.

16. The method as claimed in claim 15, wherein the system comprises an infrared linear sensor having measuring area running transversely in relation to the running direction of the strip.

17. The method as claimed in claim 15, wherein the system comprises an infrared linear sensor having measuring area running longitudinally in relation to the running direction of the strip.

18. The method as claimed in claim 16, wherein the position of the ends of the strip is recorded upstream of the edger.

19. The method as claimed in claim 17, wherein the position of the ends of the strip is recorded upstream of the edger.

20. The method as claimed in claim 16 wherein the position of the ends of the strip is recorded downstream of the edger.

21. The method as claimed in claim 17 wherein the position of the ends of the strip is recorded downstream of the edger.

22. The method as claimed in claim 16 wherein the position of the ends of the strip is recorded both upstream and downstream of the edger.

23. The method as claimed in claim 17 wherein the position of the ends of the strip is recorded both upstream and downstream of the edger.

24. A system for operating a hot rolling train comprising:

at least one edger;

at least one linear sensor or determining the position of the ends of a strip; and a means for optimizing a strip width distribution of at least one end of a strip, wherein adjustment corrections to the at least one edger are activated depending on the determination of the position of the ends of a strip.

25. The system as claimed in claim 24, wherein the linear sensor is arranged upstream of the edger.

26. The system as claimed in claim 24, wherein the linear sensor is arranged downstream of the edger.

27. The system as claimed in claim 24, further comprising another linear sensor.

28. The system as claimed in claim 27, wherein a linear sensor is arranged upstream and a linear sensor is arranged downstream of the edger.

29. The system as claimed in claim 24 wherein the linear sensor is an infrared sensor.

30. The system as claimed in claim 27 wherein the sensors are infrared sensors.

31. The system as claimed in claim 24, wherein the sensor is an infrared linear sensor having a measuring area running transversely in relation to the running direction of the strip.

32. The system as claimed in claim 24, wherein the sensor is an infrared linear sensor having a measuring area running longitudinally in relation to the running direction of the strip.

* * * * *